United States Patent [19]

Ichihara et al.

[11] Patent Number: 4,682,072

[45] Date of Patent: Jul. 21, 1987

[54] HEADLAMP FOR VEHICLE

[75] Inventors: Takeo Ichihara, Hatano; Yukio Yamanaka, Yokohama; Akihiko Tsurumaru, Sagamihara, all of Japan

[73] Assignee: Stanley Electric Co., Ltd., Tokyo, Japan

[21] Appl. No.: 935,117

[22] Filed: Nov. 26, 1986

Related U.S. Application Data

[63] Continuation of Ser. No. 634,877, Jul. 26, 1984, abandoned.

[51] Int. Cl.[4] ..... H01J 5/16

[52] U.S. Cl. ..... 313/115; 313/113; 313/114; 362/211

[58] Field of Search ..... 313/113, 115, 114; 362/211, 267, 346

[56] References Cited

U.S. PATENT DOCUMENTS 3,688,149 8/1972 Pitkjaan ..... 313/114

4,140,939 2/1979 Bonazoli et al. ..... 313/115

FOREIGN PATENT DOCUMENTS 1277850 1/1961 France ..... 362/211

505057 12/1954 Italy ..... 362/211

*Primary Examiner*—David K. Moore

*Assistant Examiner*—Michael Razavi

*Attorney, Agent, or Firm*—Weingarten, Schurgin, Gagnebin & Hayes

[57] ABSTRACT

The present invention provides a headlamp for a vehicle wherein a reflector is different in focal position of a paraboloidal surface between an upper surface and a lower surface thereof, a focal point on the lower surface side is formed to be positioned forwardly more than a length of a sub-filament from a focal point on the upper surface side, and the sub-filament is positioned between both the focal points to thereby efficiently utilize luminescense and obtain a light distribution pattern of high luminous intensity.

1 Claim, 12 Drawing Figures

HEADLAMP FOR VEHICLE

This application is a continuation of application Ser. No. 634,877, filed July 26, 1984, now abandoned.

SUMMARY OF THE INVENTION

The present invention relates to a headlamp for a vehicle in which a main beam and a sub-beam may be switched.

DESCRIPTION OF THE PRIOR ART

An example of a filament arrangement of a conventional headlamp for a vehicle is shown in FIGS. 1 and 2. FIG. 1 shows the case wherein forwardly directed main filament and sub-filament 3 (the main filament being positioned behind the sub-filament 3) are successively arranged on a rotational shaft of a paraboloidal surface of a reflector 1, and a shield plate 4 is arranged under the sub-filament 3. A light image of the sub-beam assumes an approximately semi-circle by use of about a half portion except a portion marked with oblique lines of the reflector as shown in FIG. 3 (*a*), and a light image of the main beam assumes a circle by use the whole reflector as shown in FIG. 3 (*b*).

FIG. 2 shows the case wherein a main filament 2 is arranged on a center axis of the reflector 1, and a sub-filament 3 is arranged thereabove. A light image of the main beam assumes a laterally extending elliptical shape as shown in FIG. 4 (*b*), and a light image of the sub-beam assumes a shape in which an ellipse is inflated in one direction of a short axis thereof as shown in FIG. 4 (*a*).

As will be apparent from the light images, in the filament arrangement of FIG. 1, the sub-beam is merely possible to utilize light about half of the reflector, and therefore, the rate of utilization is bad.

On the other hand, in the filament arrangement of of FIG. 2, the light image of the sub-beam tends to be spread resulting in possible short of intensity of illumination, and in addition, a gap between the main-filament 2 and the sub-filament 3 should be more than a given value. Therefore, if the center of the light image is positioned much lower than the center point of the reflector 1, correction becomes difficult to make, and lateral light is weak. If combined with a laterally extending reflector, the degree of utilization of light is low and therefore, selection of a reflector has to made carefully.

OBJECT OF THE INVENTION

In view of the foregoing, the present invention has its object to provide a headlamp for a vehicle wherein a reflector is different in focal position of a paraboloidal surface between an upper surface and a lower surface thereof, a focal point on the lower surface side is formed to be positioned forwardly more than a length of a sub-filament from a focal point on the upper surface side, and the sub-filament is positioned between both the focal points to thereby efficiently utilize luminescense and obtain a light distribution pattern of high luminous intensity.

DETAILED DESCRIPTION OF THE INVENTION

Figure 5:
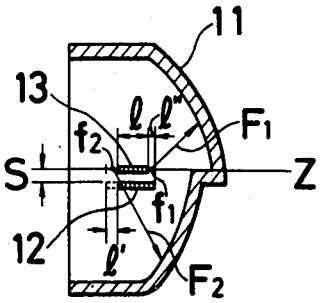
FIGS. 5 and 6 are respectively a longitudinal sectional view and a front view showing one embodiment of the present invention.
Figure 6:
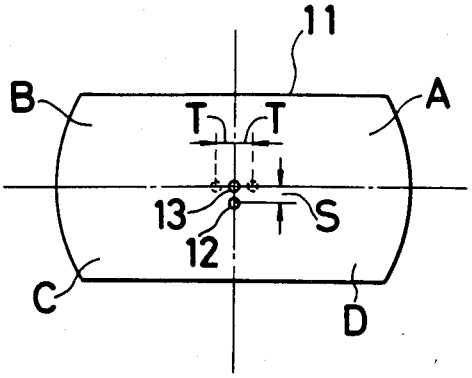

FIGS. 5 and 6 show one embodiment of the present invention. Reference numeral 11 denotes a reflector, 12 a main filament, and 13 a sub-filament.

The reflector 11 has a paraboloidal surface (reflecting surfaces A, B) of a focal length $F_1$, and a paraboloidal surface (reflecting surfaces C, D) of a focal length $F_2$. A length between focal points $f_1$, $f_2$ ($f_2$ is positioned frontwardly of $f_1$) has a value of a length l of the sub-filament 13 plus 0–1.0 mm. A boundary between both the paraboloidal surfaces is a horizontal line intersecting a rotational axis Z of the paraboloidal surface of the reflector.

The sub-filament 13 is arranged between both the focal points $f_1$, $f_2$ on the rotational axis Z of the paraboloidal surface of the reflector 11, and the main filament 12 is arranged thereunder by dimension S (1.0–3.0 mm) in parallel to the sub-filament 13. In this case, the main filament 12 is formed to be longer than the sub-filament 13 by l″ or l′ (0.5–1.5 mm), projecting rearwardly (reflector side) by $l''-l''+L/2$ or forwardly (lens side) by $l'-l'+L/2$ (where L: length of the main filament). It will be noted that both the filaments are manufactured as a bulb in the aforesaid positional relation.

Figure 7A:
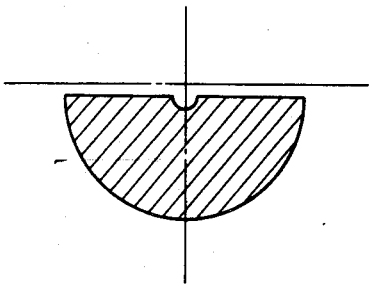
FIGS. 7 (*a*) and (*b*) show patterns of the sub-beam and main beam in the aforesaid embodiment.
Figure 7B:
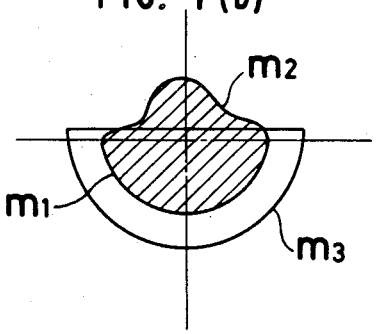

With the above-described construction, light from the sub-filament 13 will be light externally of the focal point $f_1$ with respect to the reflecting surfaces A, B of the focal length $F_1$ and focal point $f_1$, and when the light is illuminated on the reflecting surfaces A, B, an image of light is formed under the horizontal line (center line) intersecting the axis Z as shown in FIG. 7 (*a*). The afore-said light will be light within the focal point with respect to the reflecting surfaces C, D of the focal length $F_2$ and focal point $f_2$, and an image of light is formed at the same position as the reflecting surfaces A, B.

On the other hand, the main filament 12 is arranged parallel to the sub-filament 13 with a gap of dimension S (1.0–3.0 mm), and an image of light (contour $m_1$ of FIG. 7 (*b*)) is formed in a portion of the same length as the sub-filament 13 according to the same principle as the sub-beam. However, light generated from the portion of l″ is illuminated as light within the focal point with respect to the reflecting surfaces A, B of the focal length $F_1$, and an image of light (contour $m_2$ of FIG. 7 (*b*)) is formed above the center line. Light in the portion of dimension l″ will be light within the focal point with respect to the reflecting surfaces C, D of the focal length $F_2$ and has the same directivity as the portion of dimension l and therefore, a light image of contour $m_3$ of FIG. 7 (*b*) is obtained.

Figure 8:
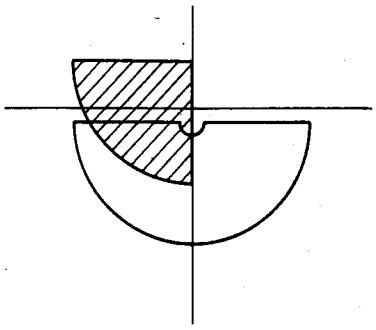
FIGS. 8 and 9 show patterns which can be realized by the present invention.
Figure 9:
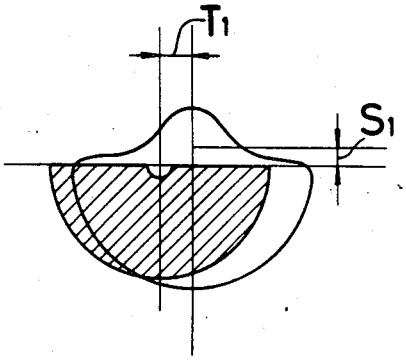

In case of the main beam, even if it is arranged while being projected frontwardly through l′, the directivity of light is merely changed in the reflecting surfaces A, B and C, D, and the combined light image is the same as the case of dimension l″. Also, an axis of a reflecting mirror of any of the reflecting surfaces A, B, C and D may be varied to vary the light image stepwise as shown in FIG. 8. This stepwise light image will be a light image convenient to find a center axis of the illuminating lamp where the illuminating lamp is mounted on the vehicle. Moreover, by varying the dimension S (gap in filament) of FIG. 6 or by varying the amount of movement T of the sub-filament 13 to right or left, it is possible not to impart dazzling to a facing vehicle and possible to preferentially brighten the rightside or leftside.

Figure 1:
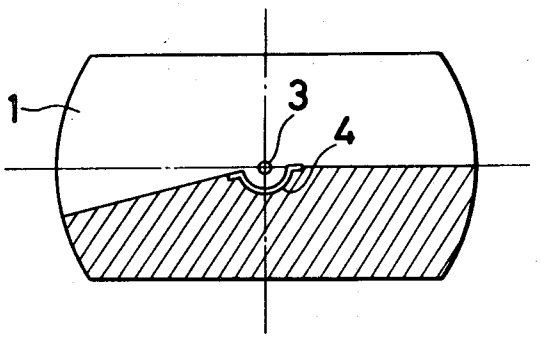
FIGS. 1 and 2 are respectively front views showing an example of a filament arrangement of a conventional headlamp for a vehicle.
Figure 2:
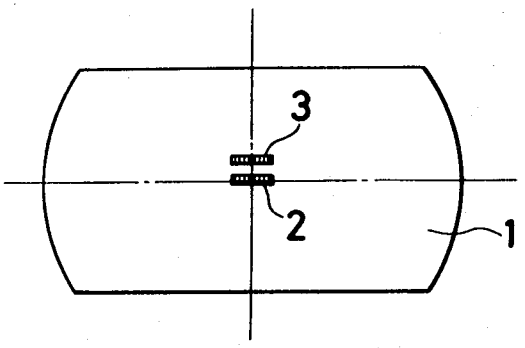
Figure 3B:
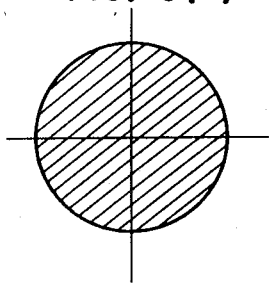
FIGS. 3 (*a*) and (*b*) and FIGS. 4 (*a*) and (*b*) show patterns of a sub-beam and a main beam in the filament arrangements of FIGS. 1 and 2.
Figure 4B:
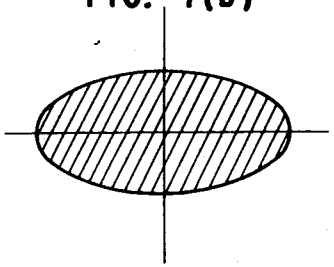
Figure 3A:
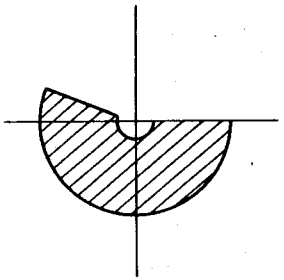
Figure 4A:
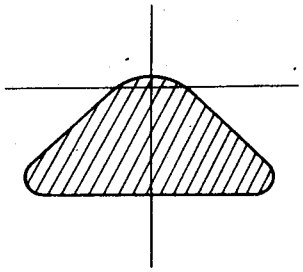

As described above, in the present invention, the sub-beam is formed by improvement in construction of the reflecting surface of the reflector and by optical consideration of arrangement of the filaments, and therefore, light is effectively utilized and a pattern of sufficient light intensity is obtained. Moreover, the minimum light of the main beam is used to illuminate the sky, and the remaining light is sued to illuminate the road surface. Therefore, the road surface can be illuminated brightly, contributing safety driving. In the type shown in FIG. 2 wherein both filaments are arranged in parallel up and down, there is a limitation in reduction of a switching width between the main beam and the sub-beam in terms of arrangement of filaments, and the sub-beam has a disadvantage in that it illuminates a short-distance portion as compared with the sub-beam of the type shown in FIG. 1 which employs the longitudinal arrangement. However, even if both filaments are likewise arranged in parallel up and down, a portion in an adequate range can be illuminated with high light-intensity. Moreover, various light images may be realized by adjustment of an axis of the reflecting mirror, and the sub-beam may be illuminated against a portion remotely located without imparting dazzling to the facing vehicle. Furthermore, by effective utilization of luminescense, there provides the advantage in that the vertical light dimension employed in the type in which the filaments are longitudinally arranged may be reduced.

What is claimed is:

1. A headlamp for a vehicle in which a main filament and a sub-filament are arranged in parallel to a rotational axis of a paraboloidal surface of a reflector, and the sub-filament is positioned above the main filament, wherein:

the reflector is different in focal position of the paraboloidal surface thereof between an upper surface and a lower surface, the focal point on the lower surface side is positioned frontwardly more than a length of the sub-filament from the focal point on the upper surface side, the sub-filament is positioned between both the focal points, and the main filament is longer than the sub-filament and is positioned thereunder and in parallel alignment therewith to produce corresponding different illumination patterns, the main filament producing a larger illumination pattern than the sub-filament, and the illumination pattern of the sub-filament being formed on proportion to the length of the sub-filament, wherein the main filament is disposed so as to extend beyond the sub-filament by an interval in the range 1 to $1+L/2$ such that 1 is the difference between the lengths of the main filament and the sub-filament, and L is the length of the main filament to thereby efficiently utilize luminescence to obtain a light distribution pattern of light luminous intensity and reduce the vertical dimension employed in said head lamp.

* * * * *